United States Patent [19]

Goff et al.

[11] 4,183,512

[45] Jan. 15, 1980

[54] CLAMPING APPARATUS

[75] Inventors: Melvin J. Goff; Gerald W. Goff, both of Kalamazoo, Mich.

[73] Assignee: Continental Pump, Inc., Portage, Mich.

[21] Appl. No.: 951,767

[22] Filed: Oct. 16, 1978

[51] Int. Cl.[2] ..... B25B 1/12

[52] U.S. Cl. ..... 269/185; 269/239; 269/249

[58] Field of Search ..... 269/184, 185, 186, 187, 269/246, 249, 237-239; 74/424.8 R; 81/159, 160, 162

[56] References Cited

U.S. PATENT DOCUMENTS

| | | | |
|---|---|---|---|
| 2,138,245 | 11/1938 | Smith | 81/162 X |
| 3,909,889 | 10/1975 | Emerson | 269/238 |

*Primary Examiner*—Robert C. Watson

*Attorney, Agent, or Firm*—Gordon W. Hueschen

[57] ABSTRACT

A clamping apparatus is actuated to clamping position by a reciprocating elongated member having a clutch mechanism which either permits or does not permit reciprocation of the elongate member according to the rotative position of the elongate member in the clutch and a screw means for advancing the clamping face when the unit formed by the clutch in engagement with the elongate member is rotated. The clutch is designed so that it does not disengage until after a workpiece is unclamped.

5 Claims, 10 Drawing Figures

CLAMPING APPARATUS

FIELD OF THE INVENTION AND PRIOR ART

The invention relates to a clamping apparatus which is adapted to be moved quickly to clamping position and thereafter moved to effect clamping.

Such devices are disclosed in U.S. Pat. Nos. 2,313,361; 2,396,823; and, 4,083,624. In general, they comprise screw means which move axially on being rotated, an elongate member for reciprocating movement axially in the screw means, axial movement of which actuates the clamping apparatus into and out of clamping position, and a clutch-type mechansim in the screw means such that, on rotation of the elongate member, a friction-type engagement is effected between the screw means and the elongate member such that further rotation of the elongate member causes the screw means to rotate and the elongate member to move toward clamping position.

Devices of this kind have the disadvantage that the maximum amount of pressure which can be inserted by the clamp is determined by the frictional engagement between the elongate member and the screw means. Further, they have the disadvantage that either the screw means must be fully back-rotated before the elongate member can be disengaged, or, if means is provided to obviate this, as in U.S. Pat. No. 4,083,624, means is needed so that the screw means can be back-rotated by hand, when necessary.

Devices of this kind also have the disadvantage that the clutch mechanism disengages before a workpiece is unclamped, so that if the workpiece has inherent resiliency, as soon as the clutch mechanism releases, the elongate member tends to jump out of the clutch mechanism, with the possibility of causing injury to the user.

OBJECTS OF THE INVENTION

It is an object of the invention to provide an improved clamping apparatus. It is a further object of the invention to provide an improved clamping apparatus of the character described, which is safe and effective for the purpose intended. It is a further object of the invention to provide such a clamping apparatus in which pressure on the workpiece is released before the clutch mechanism is disengaged. It is a further object of the invention to provide a clamping apparatus of the class described in which the screw means for advancing the clamping face toward clamping position, and back, is integral with the elongate member and not a part of the clutch mechanism. It is a further object of the invention to provide a clamping apparatus of the class described which is efficient and economical to manufacture, which is rugged and not subject to malfunction, which avoids the disadvantages of the prior art, and which has advantages as will appear as the description proceeds.

BRIEF DESCRIPTION OF THE INVENTION

The invention relates to an improvement in a clamping apparatus of the type which comprises a base member having a clamping face fixed relative thereto and a complementary clamping face moveable toward and away from juxtaposition with the fixed clamping face, together with moving and clamping means for moving the complementary clamping face toward and away from juxtaposition with the fixed clamping face; and for clamping a workpiece between the two faces, and is particularly directed to improvements in the moving and clamping means, comprising an elongate member having a complimentarily-threaded member into which said threaded end is threaded, which is connected to, and moveable as a unit, with the complementary clamping face but not axially rotatable, whereby, when the elongate member is rotated in the retracting direction, the threaded member and the complementary clamping face are retracted and moved away from the fixed clamping face, and, in the advancing direction are advanced and moved toward the fixed clamping face; a rotatable sleeve mounted on said base member for axial rotation but not axial movement relative thereto and through which the elongate member projects, said sleeve comprising a clutch mechanism operative when the elongate member is rotated in the retracting direction, to permit the elongate member to move axially in the sleeve, and, in the advancing direction, to lock the two together and to prevent axial movement of the elongate member in the sleeve, whereby the complementary clamping face can be quickly advanced into engagement with a workpiece, the elongate member rotated to lock it to the sleeve, and then rotated further to clamp the workpiece between the two clamping faces.

Advantageously, the sleeve has a thrust bearing between it and the base member such that the force necessary to disengage the clutch mechanism and unlock the locked unit comprising the elongate member and the rotatable sleeve, is greater than that necessary to rotate the locked unit, whereby pressure on the workpiece is gradually reduced by unscrewing the threaded end of the elongate member from the complementarily-threaded member before the elongate member and the rotatable sleeve are disengaged.

In the preferred form of the invention, the clamping faces are at the apposed ends of a pincer-like vice comprising two dogleg-shaped members, one of which comprises the base member and the other of which is pivoted intermediate its knee and its free end, in which the threaded member is journaled to the knee of the pivoted leg, and in which the rotatable sleeve is journaled to the free end of the leg which comprises the base member.

Advantageously, the clutch mechanism comprises complementary transverse lands and grooves on the elongate member and the rotatable sleeve, so that in one relative position they are engaged and in another relative position they are disengaged. Advantageously, stop means are provided which prevents rotation of the elongate member in one direction beyond the fully engaged position and in the other direction, beyond the fully disengaged position.

The invention can also be embodied in a "C" clamp, in whch case a traveler is provided to prevent rotation of the complementarily-threaded member.

DETAILED DESCRIPTION OF THE INVENTION

Figures 1, 2, 3, 4, 5, 6, 7, 8, 9, 10:
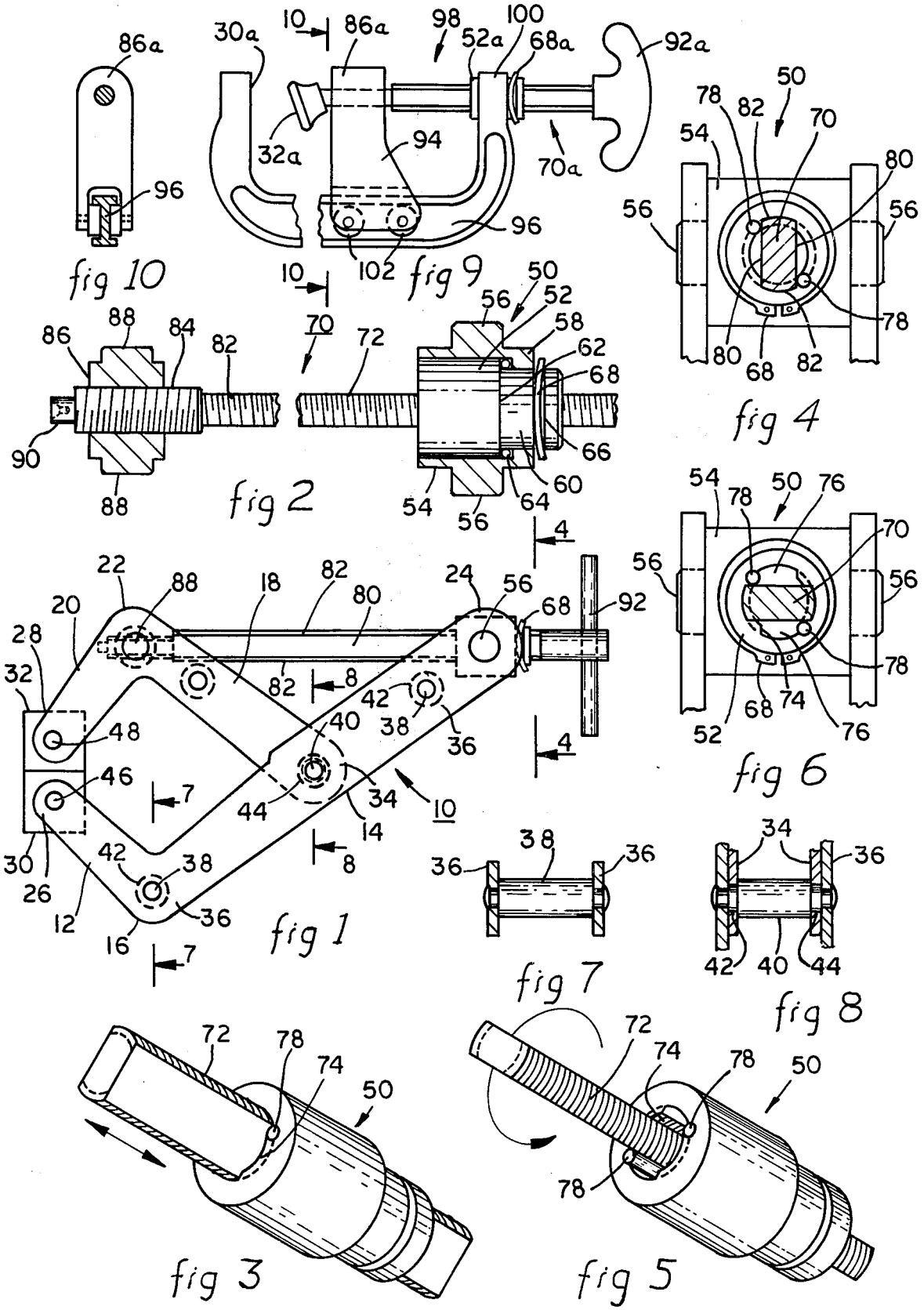
FIG. 1 is a side elevation of one form of the invention.
FIG. 2 is a detailed view of part of FIG. 1.
FIG. 3 is a detailed view of part of FIG. 1.
FIG. 4 is a partial view taken along line 4—4 of FIG. 1.
FIG. 5 is a detailed view of FIG. 3.
FIG. 6 is a view similar to FIG. 4, showing the elongate member in engaged position.
FIG. 7 is a detailed view, in cross-section, taken along line 7—7 of FIG. 1.
FIG. 8 is a detailed view in section taken along line 8—8 of FIG. 1.
FIG. 9 is a side elevation of another form of the invention.
FIG. 10 is a detailed view in section, taken along line 10—10 of FIG. 9.

In the modification shown in FIGS. 1 through 8, the clamp comprises a base member 10, shaped in the form of a dogleg, having a leg portion 12, a side portion 14, and a knee 16. Apposed thereto in a pincer-like structure, is a second dogleg-shaped member comprising a side portion 18, a leg portion 20, and a knee 22.The free end of the side portion 18 is journaled to the side portion of the side portion 14, intermediate the knee 16 and the free end 24. At the free ends 26 and 28 of the legs 12 and 20, are clamping faces 30 and 32. As shown in FIGS. 7 and 8, each dogleg comprises complementary parallel members 34 and 36 riveted together by rivets 38 and 40. In FIG. 8, the rivet 40 has a shoulder 42 and 44 slightly longer than the member 34 so that the rivet 40 can be riveted tight up against the members 36 without causing the member 34 to bind against member 36. The clamping faces 30 and 32 are pivoted between the members 36 and 34, respectively, on pins or trunnions 46 and 48.

In FIGS. 2, 3, 4, 5, and 6 there is shown a clutch mechanism 50, comprising a rotatable sleeve 52 mounted in the housing 54, having trunnions 56, journaled in the free ends of the base member 10, as shown in FIG. 1. The housing 54 has a shoulder 58, and the sleeve 52 has a complementary portion 60 of reduced diameter providing the shoulder 62, which is apposed to the shoulder 58. Between the two shoulders 58 and 62 is a thrust bearing 64. The portion 60 of the sleeve which extends beyond the shoulder 58 has an annular groove or channel 66 into which is fitted a bowed, slit-ring retainer 68. Thus the sleeve 52 is free to rotate in the housing 54 but, is not free to move axially with respect thereto.

Disposed in sleeve 52 is an elongate member 70, having lands and grooves 72, which are complementary with lands and grooves 74 in the sleeve 52. The lands and grooves 74 extend only part way around the sleeve 52, thus providing channels 76, which are complementary to the shape of the elongate member 70. Thus, when the elongate member 70 is in the position shown in FIG. 4 and FIG. 3 the elongate member can be reciprocated in the sleeve, that is, moved axially therein; however, when it is in the position shown in FIGS. 5 and 6, the complementary lands and grooves are engaged so that the elongate member 70 cannot reciprocate therein.

Stop means 78 are provided which note the relative rotation of the sleeve and the elongate member from the position shown in FIG. 4, where they are not engaged, to the position shown in FIG. 6, where they are fully engaged.

The elongate member has flat sides 80, and arcuate ends 82. The lands and grooves in the sleeve 52 advantageously are formed by a female thread therein. The lands and grooves on elongate member 70 are formed by complementary male threads thereon.

The free end of the elongate member 70 is threaded as shown at 84, and is threaded into a complementarily-threaded member 86, having trunnions 88, which are journaled between the side member 34 at the knee 22. The end of the shaft is turned down to form a pilot, as shown at 90, so that the threaded member 84 can easily be threaded into the member 84. Also, if the shaft is turned all the way out, the pilot keeps the pinion from rotating and letting the shaft become disengaged. If desired, stop means, such as a cotter pin, a split retainer, nut or screw cap can be provided to prevent the member 84 from being screwed out all the way but lacks the versatility of the form shown.

The elongate member 70 is provided with a handle 92, so that it can be rotated by hand.

In the operation of the device shown in this modification, the handle 92 is rotated to the position shown in FIGS. 1, 3, and 4, and the handle withdrawn. This pulls the dogleg back and the face 32 away from the face 30. The workpiece is then placed on face 30 and the elongate member 70 until the face 32 engages it. Then, the elongate member 70 is rotated clockwise to the position shown in FIGS. 2, 5, and 6, where the sleeves 52 and the elongate member become united as a unit. Then, further rotation of the elongate member 70 clockwise causes the threaded end 84 to advance the complementarily-threaded member 86 and to clamp the workpiece between the clamping faces 30 and 32. When the elongate member 70 is rotated in the opposite direction, the reverse procedure takes place. First, the workpiece is unclamped, then the elongate member is disengaged from the sleeve 52 and rotates to the position shown in FIGS. 1, 3, and 4. Then it can be quickly withdrawn to completely free the workpiece. In this way the workpiece is resilient, all pressure is relieved on it before the elongate member 70 and the sleeve 52 are disengaged so that the elongate member 70 never springs out from the sleeve 52, as it often does in the prior art devices.

In the modification shown in FIGS. 9 and 10, the complimentarily-threaded member 86a is comprised in the traveler 94, mounted to ride in channels 96 on the bottom portion of a "C" clamp 98.

The sleeve 52a is mounted for rotation in one end 100 of the "C" clamp, in the same way that it is mounted in the housing 54. The elongate member 72*a*, with its handle 92*a*, is constructed as previously described, so that when it is rotated clockwise it advances the traveler 94, and brings the moveable clamping face 32*a* in juxtaposition with the fixed clamping face 30*a*. The traveler 94 is provided with rollers 102 adapted to roll in the channel 96. Thus, when the handle 92*a* is rotated clockwise, the traveler 94 is advanced, and when it is rotated counterclockwise, elongate member 70*a* is disengaged from the sleeve 52*a*, so that the elongate member 70*a* can be withdrawn as described in connection with the other modification.

It is to be understood that the invention is not to be limited to the exact details of operation or structure shown and described, as obvious modifications and equivalents will be apparent to one skilled in the art.

We claim:

1. In a clamping apparatus comprising a base member having a clamping face fixed relative thereto and a complementary clamping face moveable toward and away from juxtaposition with the fixed clamping face, and moving and clamping means for moving said complementary clamping face toward and away from juxtaposition with said fixed clamping face and for clamping a work piece between the two clamping faces, the combination in which said moving and clamping means comprises; an elongate member having a threaded end; a complementarily-threaded member in which said threaded end is threaded, said complementarily-threaded member being connected to and moveable as a unit with said complementary clamping face but not axially rotatable, whereby, when said elongate member is rotated in the retracting direction, said threaded member and said complementary clamping face are retracted and moved away from said fixed clamping face and, in the advancing direction, are advanced and moved toward said fixed clamping face; a rotatable sleeve mounted on said base member for axial rotation but not axial movement relative thereto and through which said elongate member projects, said sleeve comprising a clutch mechanism operative when said elongate member is rotated in the retracting direction to permit said elongate member to move axially in said sleeve and, in the advancing direction, to lock the two together and to prevent axial movement of said elongate member in said sleeve, whereby said complementary clamping face can be quickly advanced into engagement with a workpiece, the elongate member rotated to lock it to said sleeve and then rotated further to clamp said workpiece between the two clamping faces.

2. The clamping apparatus of claim 1 in which said sleeve has a thrust bearing between it and said base member such that the force necessary to disengage said clutch mechanism and unlock the locked unit comprising said elongate member and said rotatable sleeve is greater than that necessary to rotate the locked unit, whereby pressure on the workpiece is gradually reduced by unscrewing the threaded end of said elongate member from said complementarily-threaded member before said elongate member and said rotatable sleeve are disengaged.

3. The clamping apparatus of claim 1 in which the clamping faces are at the apposed ends of a pincer-like vice comprising two dogleg-shaped members, one of which comprises said base member and the other of which is pivoted thereto intermediate its knee and its free end; in which said threaded member is journaled to the knee of the pivoted leg; and in which said rotatable sleeve is journaled to the free end of the leg which comprises said base member.

4. The clamping apparatus of claim 1 in which said elongate member is a bar having apposed flat sides and apposed arcuate sides having arcuate transfer lands and grooves.

5. The clamping apparatus of claim 1 which further comprises stop means which prevent said elongate member from being rotated beyond the position in which the complementary lands and grooves are fully engaged or beyond the position in which they are fully disengaged.

* * * * *